US007942626B2

(12) United States Patent
Nikpour

(10) Patent No.: US 7,942,626 B2
(45) Date of Patent: May 17, 2011

(54) COMPRESSOR

(75) Inventor: Bahram Nikpour, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 173 days.

(21) Appl. No.: 12/316,371

(22) Filed: Dec. 11, 2008

(65) Prior Publication Data

US 2009/0155047 A1 Jun. 18, 2009

Related U.S. Application Data

(63) Continuation of application No. PCT/GB2007/002096, filed on Jun. 8, 2007.

(30) Foreign Application Priority Data

Jun. 17, 2006 (GB) ..... 0612035.6
Nov. 25, 2006 (GB) ..... 0623759.8

(51) Int. Cl.
*F03B 11/04* (2006.01)

(52) U.S. Cl. ..... 415/58.3; 415/119; 415/189

(58) Field of Classification Search ..... 415/11, 415/58.2, 58.3, 58.4, 119, 214.1, 914, 189, 415/185
See application file for complete search history.

(56) References Cited

U.S. PATENT DOCUMENTS

| | | | | |
|---|---|---|---|---|
| 4,743,161 | A | 5/1988 | Fisher et al. | |
| 5,295,785 | A | 3/1994 | Church et al. | |
| 6,196,789 | B1 | 3/2001 | McEwen et al. | |
| 6,648,594 | B1 * | 11/2003 | Horner et al. | 415/145 |

FOREIGN PATENT DOCUMENTS

| | | |
|---|---|---|
| EP | 0526965 | 2/1993 |
| GB | 2 256 460 | 12/1992 |
| JP | 2005240569 | 9/2005 |
| WO | WO 01/09517 | 2/2001 |

* cited by examiner

*Primary Examiner* — Edward Look
*Assistant Examiner* — Dwayne J White
(74) *Attorney, Agent, or Firm* — Krieg DeVault LLP; J. Bruce Schelkopf, Esq.

(57) ABSTRACT

A compressor for compressing a gas comprises an impeller wheel mounted within a housing (2) defining an inlet and an outlet. The inlet comprises a map-width enhanced structure with an annular flow passage (11) defined between inner (9) and outer (7) tubular walls. The flow passage (11) is in fluid communication with the impeller wheel by virtue of a slot (13) in the inner wall (9). A flow-conditioning member (14) is positioned in the annular flow passage (11) and serves to remove swirl from the gas flow that recirculates through the passage. The flow-conditioning member (14) comprises a body penetrated by a plurality of bores (15). The arrangement provides for a significant improvement in the surge margin of the compressor and is particularly suitable for use in a turbocharger.

14 Claims, 4 Drawing Sheets

Fig. 2
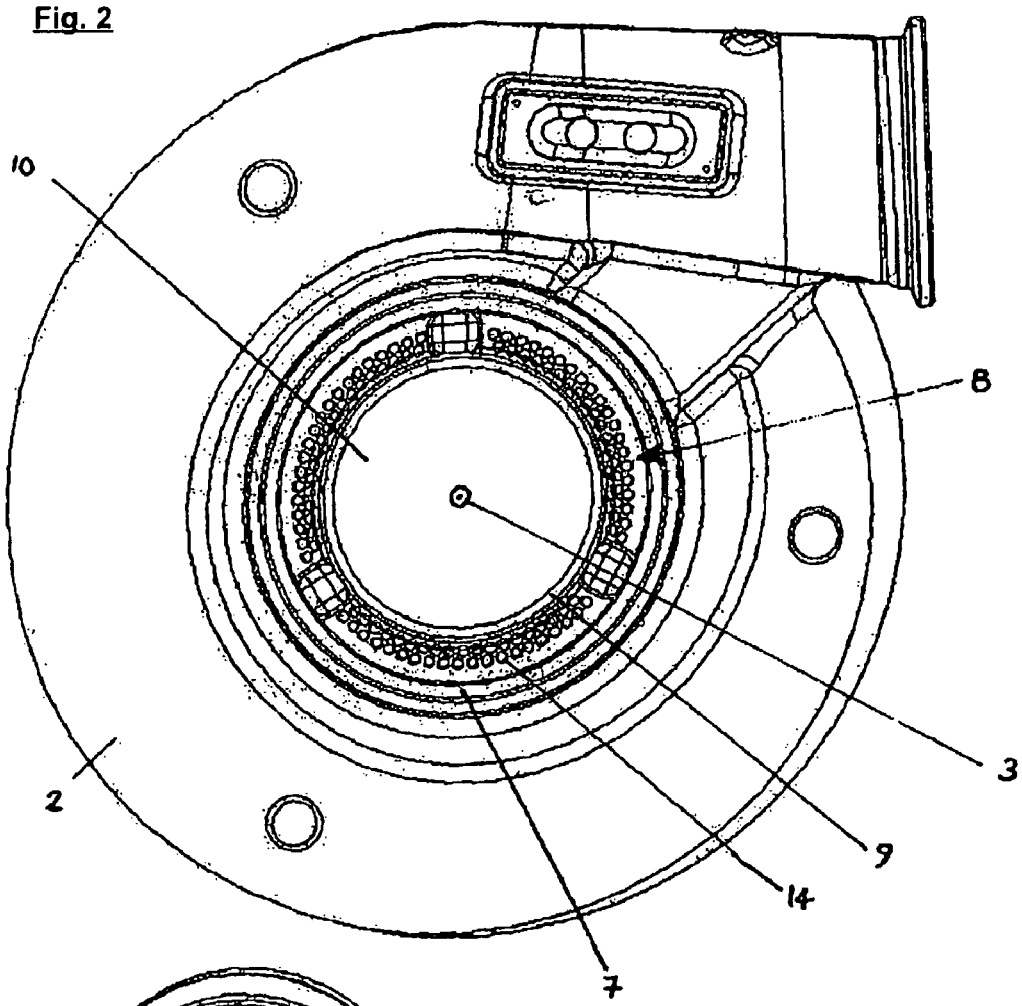
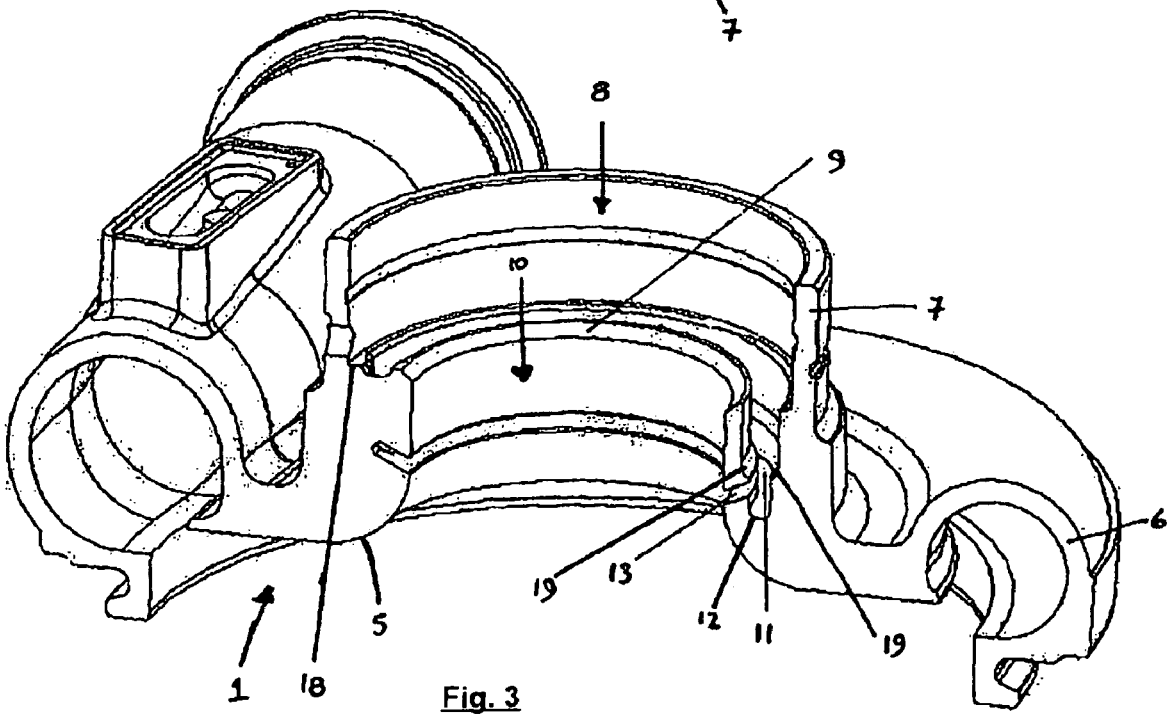
Fig. 3

Efficiency (T-T)
85
80
75
70
65
60
55
50
0
20
40
60
80
100
120

Surge margin improvement
Conventional MWE
MWE with de-swirl device fitted
Corp. Speed (rpm/√K)
98.2
88.4
78.6
68.7
58.9
Pressure Ratio (T-T)
5.5
5.0
4.5
4.0
3.5
3.0
2.5
2.0
1.5
1.0
0
20
40
60
80
100
120
m√T/p Corp. (kg/sec.√K/MPa)

COMPRESSOR

CROSS REFERENCE TO RELATED APPLICATIONS

The present application is a continuation of PCT/GB2007/002096 filed on Jun. 8, 2007. The PCT application claims priority to United Kingdom Patent Application No. GB0612035.6, filed Jun. 17, 2006 and United Kingdom Patent Application No. GB0623759.8 filed Nov. 25, 2006, all of which are incorporated herein by reference.

CROSS REFERENCE TO RELATED APPLICATIONS

1. Technical Field

The present invention relates to a compressor. In particular, the invention relates to the inlet arrangement of a centrifugal compressor and to a turbocharger incorporating such a compressor.

2. Background

A compressor comprises an impeller wheel, carrying a plurality of blades (or vanes) mounted on a shaft for rotation within a compressor housing. Rotation of the impeller wheel causes gas (e.g. air) to be drawn into the impeller wheel and delivered to an outlet chamber or passage. In the case of a centrifugal compressor the outlet passage is in the form of a volute defined by the compressor housing around the impeller wheel and in the case of an axial compressor the gas is discharged axially.

The turbocharger is a well-known device for supplying air to the intake of an internal combustion engine at pressures above atmospheric (boost pressures) and is widely used on automobiles and the like. FIG. 1 illustrates a conventional turbocharger to which the present invention may be applied. A compressor 102 is joined to a turbine 101 via a central bearing housing 103. The turbine comprises a turbine housing 104 that houses a turbine wheel 105. Similarly the compressor 102 comprises a housing 106 that houses an impeller wheel 107. The turbine and compressor impeller wheels 105, 107 are mounted on opposite ends of a common turbocharger shaft 108, the shaft being supported on bearing assemblies 109 in the bearing housing 103. The turbine housing 104 is provided with an exhaust gas inlet 110 and an exhaust gas outlet 111. The inlet 110 directs incoming exhaust gas from an internal combustion engine to an annular inlet chamber 112 surrounding the turbine wheel 105. The exhaust gas flows through the turbine and into the outlet 111 via a circular outlet opening that is coaxial with the turbine wheel. This drives the turbine wheel in rotation, which, in turn, rotates the compressor impeller 107. Air is drawn through an axial inlet 113 and delivers compressed air to the intake manifold of the internal combustion engine, via annular outlet volute 114, thereby increasing engine power.

One aspect of turbocharger control is to ensure stable operation by avoiding what is known as surge. If the turbocharger is operating at a relatively low compressor speed (i.e. low volumetric air flow rate) and a high boost pressure the air flow into the compressor may stall and the operation of the compressor is interrupted. Following stall, the air flow tends to reverse through the compressor until a stable pressure ratio is reached at which the air can flow in the correct direction. This process repeats and results in pulsations in the air flow known as surging. Maximum operating efficiency of the engine is achieved by operating close to the surge limit and a surge margin is built into the control process to ensure that the turbocharger operates at a safe distance from the surge condition.

In some turbochargers the compressor inlet has a structure that has become known as a "map width enhanced" (MWE) structure. An MWE structure is described for instance in U.S. Pat. No. 4,743,161. The inlet of such an MWE compressor comprises two coaxial tubular inlet sections, an outer inlet section or wall forming the compressor intake and inner inlet section or wall defining the compressor inducer, or main inlet. The inner inlet section is shorter than the outer inlet section and has an inner surface that is an extension of a surface of an inner wall of the compressor housing which is swept by edges of the impeller wheel blades. The arrangement is such that an annular flow path is defined between the two tubular inlet sections, the path being open at its upstream end and provided with apertures at its downstream end that communicate with the inner surface of the compressor housing that faces the impeller wheel. In operation, at relatively high r.p.m. the pressure in the compressor housing falls below atmosphere and air flows in through the annular flow path thus increasing the volume of air being compressed by the impeller. At relatively low r.p.m. excess air tends to bleed out of the housing, through the apertures, along the annular flow path and is recirculated to the intake.

It is well known that the MWE structure stabilises the performance of the compressor increasing the maximum flow capacity and improving the surge margin, i.e. decreasing the flow at which the compressor surges, so that the range of engine r.p.m. over which the compressor can operate in a stable manner is increased. A given compressor can thus be matched to engines with a wider speed range. This is known as increasing the width of the compressor "map", which is a plot of the compressor characteristic.

SUMMARY

It is an object of the present invention to provide for a compressor with improved performance.

According to a first aspect of the present invention there is a compressor for compressing a gas, the compressor comprising: a housing having an inlet and an outlet; an impeller wheel including a plurality of vanes, the wheel being rotatably mounted within the housing between said inlet and outlet; the housing having an inner wall defining a surface located in close proximity to radially outer edges of impeller vanes which sweep across said surface as the impeller wheel rotates about its axis; the inlet comprising an outer tubular wall extending away from the impeller wheel in an upstream direction and forming a gas intake portion of the inlet and an inner tubular wall extending away from the impeller wheel in an upstream direction within the outer tubular wall and defining an inducer portion of the inlet and substantially annular gas flow passage defined between the inner and outer tubular walls, the substantially annular gas flow passage being in fluid communication with the impeller wheel; and a perforated flow-conditioning member in said flow passage that permits communication between the inlet and the impeller wheel, the flow-conditioning member being perforated by a plurality of flow conduits that extend in substantially the axial direction.

The flow-conditioning member serves to ensure that the air flow in the annular gas flow passage is directed in the desired manner but does not affect the entire flow through the inlet. In one arrangement it serves to straighten flow through the passage and de-swirls the recirculating surge flow in the annular gas flow passage. Tests have indicated that this improves the surge margin of the compressor or turbocharger.

The flow-conditioning member also straightens the air flow into the compressor housing. Preliminary testing indicates that this may serve to improve the efficiency and pressure ratio of the compressor.

The flow-conditioning member may be annular and may be removably located as an insert in the passage.

The flow conduits may be of any suitable form. In one example they are in the form of bores penetrating the flow-conditioning member. They may be substantially circular in cross section and may be substantially constant in diameter. They may be arranged to have their central axes in parallel with each other and/or in parallel with the central axis of the inlet.

The flow conduits are arranged in a plurality of annular rows around the conditioning member and the rows may be angularly offset from one row to an adjacent row.

There may be an opening in the housing to provide communication between the flow passage and the impeller wheel. The opening may be in the form of at least one slot. The opening may be in the inner tubular wall.

There may be at least one transition step in the inner or outer tubular wall that serves to reduce the width of the annular flow passage and provides a location stop for the flow-conditioning member. The transition step may be defined by at least one taper. The transition step may be an annular ledge and the flow-conditioning member has an annular lip that abuts said ledge.

The flow-conditioning member may have at least one fixing element by which it may be fixed in position by a fixing member. The fixing element may be a lug formed in a surface of the member that faces upstream of the impeller.

The compressor according to the present invention is suited for inclusion in a turbocharger.

According to another aspect of the present invention there is provided a turbocharger comprising a compressor as defined above.

Other advantageous features of the invention will be apparent from the following description.

BRIEF DESCRIPTION OF THE FIGURES

A specific embodiment of the present invention will now be described, by way of example only, with reference to the accompanying drawings, in which:

FIG. 2 is a front view of an MWE compressor according to the present invention;

FIG. 3 is a cut away perspective view from the side of the compressor housing of FIG. 2 with a flow-conditioning member removed so as to illustrate an MWE flow passage;

DETAILED DESCRIPTION

Figure 1:
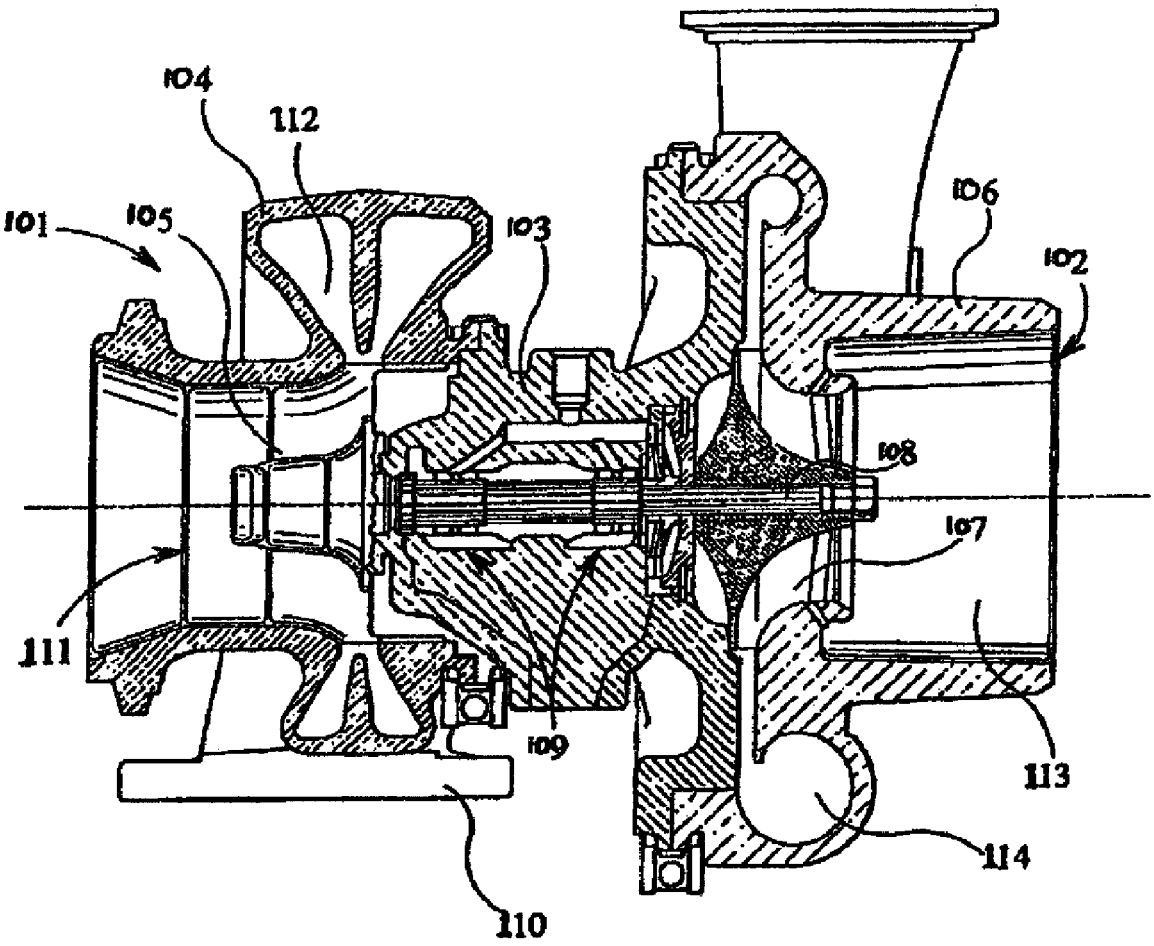
FIG 1 PRIOR ART
FIG. 1 is an axial cross-section through a conventional turbocharger, to which the present invention may be applied, illustrating the major components of a turbocharger and a conventional compressor wheel assembly.
Figure 5:
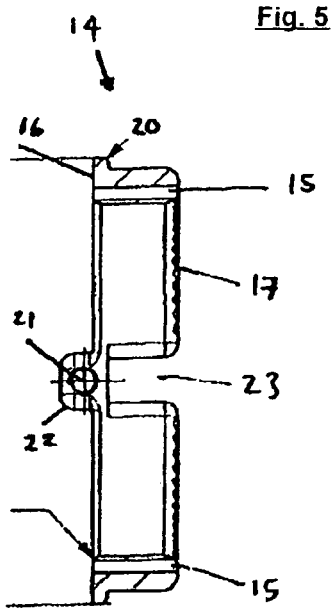
FIG. 5 is a section through the flow-conditioning member along a diameter thereof.
Figure 4:
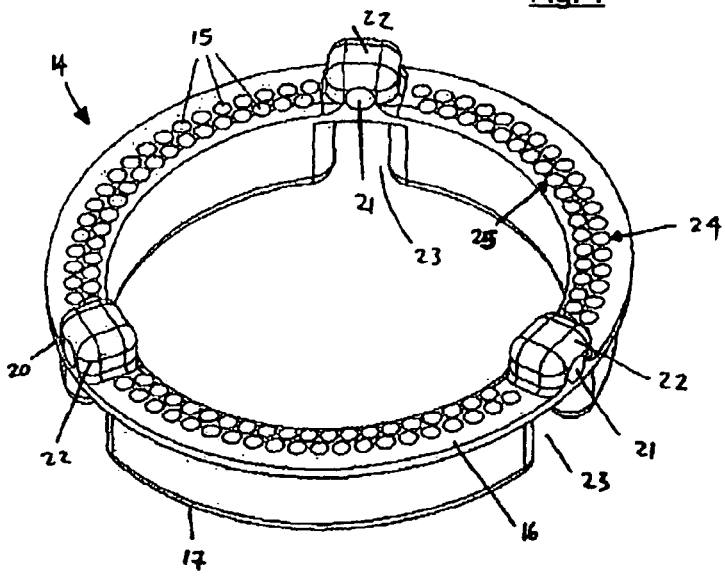
FIG. 4 is a perspective view of a flow-conditioning member of the compressor of FIG. 2.
Figure 6:
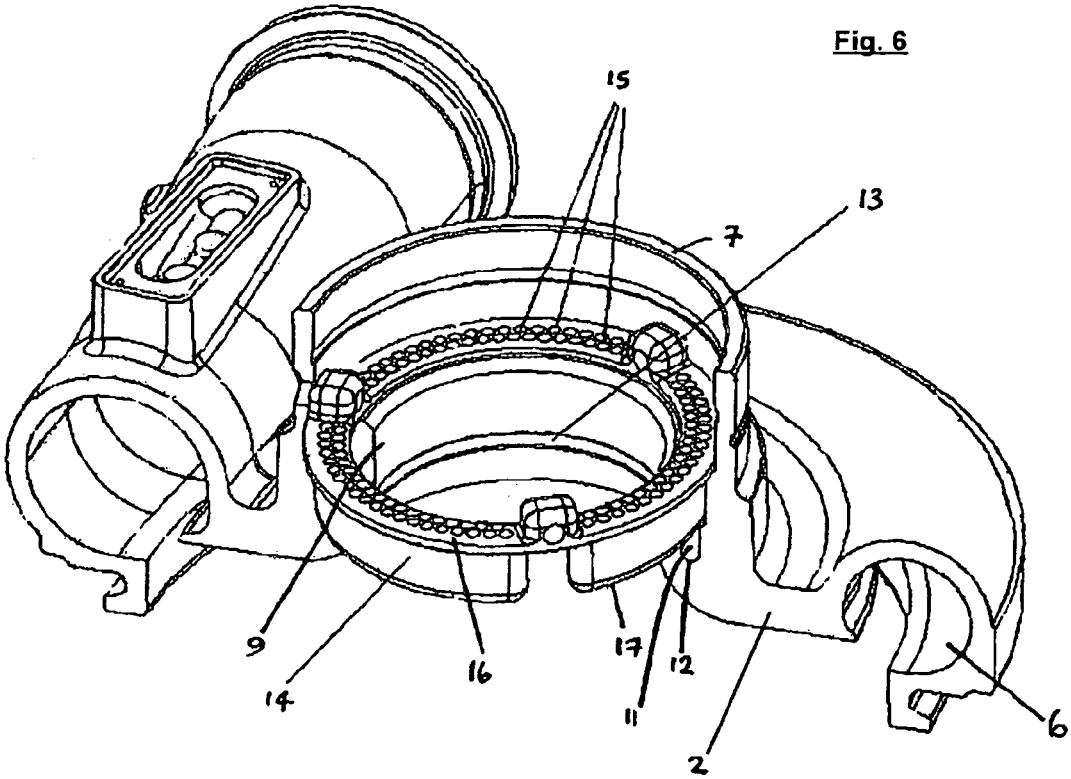
FIG. 6 is a cut away perspective view corresponding to that of FIG. 3 but with the flow conditioning member shown.

Referring to FIGS. 2 to 6, the illustrated compressor is a centrifugal compressor of the kind used in a turbocharger. The compressor comprises an impeller wheel mounted within a compressor housing 2 on one end of a rotating shaft (not shown) that extends along a compressor axis 3. For the purposes of clarity the impeller wheel is not shown in the figures but the space it occupies is generally indicated by reference numeral 1. The wheel typically has a plurality of vanes each of which has an outer edge that sweeps across a housing inner surface 5 when the impeller wheel rotates about the axis 3.

The compressor housing 2 defines an outlet volute 6 surrounding the impeller wheel and an integral MWE inlet structure 5 comprising an outer tubular wall 7 extending upstream of the impeller space 1 and defining an intake 8 for gas such as air and an inner tubular wall 9 which extends part way into the intake 8 and defines the compressor inducer 10. An annular flow passage 11 is defined around the inducer 10 between the inner and outer walls 9 and 7 and is known as the MWE passage. The passage 11 is open to the intake portion 8 of the inlet at its upstream end and closed at its downstream end by an end wall 12 that is part of the housing 2, but communicates with the impeller wheel via a discontinuous slot 13 formed through the inner wall 9 at a position adjacent to the end wall 12.

The compressor housing 2 is a unitary cast structure and is designed to connect to a bearing housing (not shown, in FIG. 2 to 6, but which is substantially similar to that shown in FIG. 1) of the turbocharger.

A flow-conditioning member 14 is disposed in the annular flow passage 11 interposed between the inner and outer walls 9, 7. This serves, in use, to orientate the flow of recirculating air in the annulus such that it is generally free of swirl and turbulence. The member 14 comprises an annular body perforated axially by a plurality of cylindrical bores 15 of constant diameter. The body is inserted into the MWE passage 11 and is designed to be a snug fit therein with a first end 16 that faces upstream and an opposite second end 17 that faces the end wall 12. The inner and outer walls 9, 7 that define the MWE passage are profiled to receive the insert member 14 at a desired axial position. In particular, the inwardly facing surface of the outer wall 7 of the flow passage 11 is stepped to form a ledge 18 at an axial position that coincides with the end of the inner wall 9. Furthermore, the walls 7, 9 taper slightly towards each other at a position 19 immediately upstream of the slot 13, the taper being in a direction so as to reduce the radial width of the MWE flow passage 11. The first end 16 of the insert member 14 has a small radial lip 20 that abuts the ledge 18 when the member 14 is inserted fully into the flow passage 11. In this position the second end 17 of the member 14 is received between the tapered portions 19 of the inner and outer walls 9, 7 and the annular slot 13 is not covered. The inserted member 14 is fixed in place by means of fixing bolts that pass though threaded apertures 21 in three fixing lugs 22 that protrude from the first end 16. The body has cut-out portions 23 below the lugs 22.

The bores 15 in the flow-conditioning member 14 (best seen in FIGS. 4 and 5) are arranged in two concentric annular rows 24, 25, with the bores 15 of one row being angularly offset from those of the adjacent row. The bores in the exemplary embodiment extend in a direction such that their central axes extend in parallel to each other and to the central axis of the inlet, but it is to be appreciated that this may be varied according to the particular requirements and application. The density of packing of the bores is carefully selected in order to ensure that there is adequate airflow through the MWE annulus.

Figure 7B:
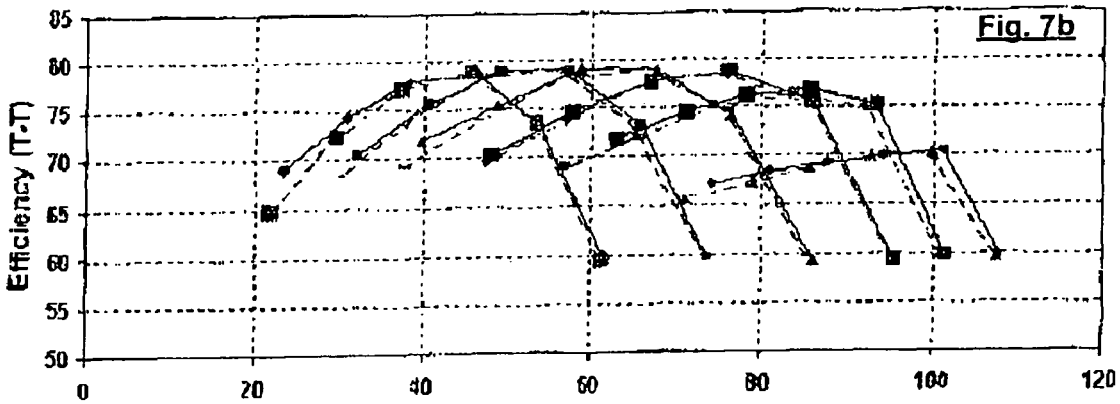
FIGS. 7A and 7B are compressor maps illustrating the improved performance of the compressor of the present invention compared to a prior art compressor.
Figure 7A:
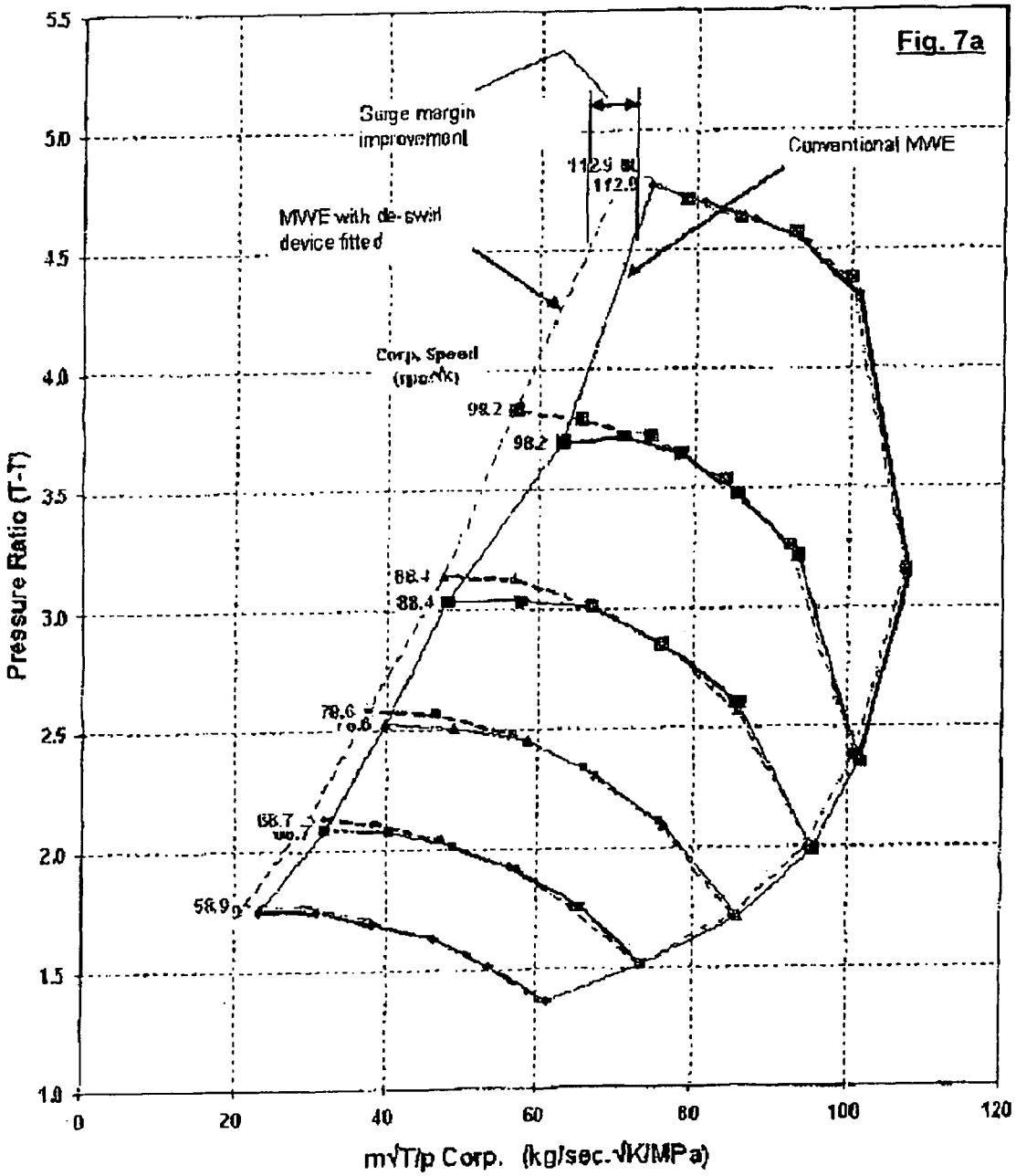

In operation, the conditioning member serves to straighten and de-swirl the re-circulating air in the MWE passage but has no effect on the air passing through the inducer. Tests have established that this provides an improvement in the surge margin of the compressor with little or no effect on the efficiency as can be seen from the compressor maps shown in FIGS. 7A and 7B. In the map of FIG. 7A the pressure ratio (y axis) of outlet to inlet is plotted against the mass of air flow (x axis) through the compressor corrected to a standard temperature and pressure for a range of rotational speeds of the compressor impeller. The plot for a prior art compressor is illustrated in solid line with the performance of the compressor of the present invention represented in dotted line. The efficiency of the two compressors is similarly plotted against air flow in FIG. 7B. In FIG. 7A the surge limit is represented by the line at the left hand extremity of each plot. It can be seen that with the flow conditioning member inserted the surge margin improve considerably (up to around 15%) throughout a range of compressor speeds. It will also be noted that the efficiency of the compressor at different speeds is not impaired significantly (FIG. 7B).

It will be appreciated that numerous modifications to the above described designs may be made without departing from the scope of the invention as defined in the appended claims. For example, the exact size, shape and arrangement of the bores in the flow-conditioning member may be varied according the application and conditions of use. In particular more than two annular rows of bores may be adopted. Furthermore, the bores may not be of constant diameter throughout, but may, for example, be tapered. Moreover, the inner and outer walls of the flow passage can be of any suitable tubular form and not necessarily of circular cross-section. Similarly the flow passage may be substantially annular and does not have to be circular. Compressors in accordance with the present invention may have many applications and in particular are suitable for incorporation in turbochargers.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilised in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a", "an", "at least one", or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A compressor for compressing a gas, the compressor comprising: a housing having an inlet and an outlet; an impeller wheel including a plurality of vanes, the wheel being rotatably mounted within the housing between said inlet and outlet; the housing having an inner wall defining a surface located in close proximity to radially outer edges of impeller vanes which sweep across said surface as the impeller wheel rotates about its axis; the inlet comprising an outer tubular wall extending away from the impeller wheel in an upstream direction and forming a gas intake portion of the inlet and an inner tubular wall extending away from the impeller wheel in an upstream direction within the outer tubular wall and defining an inducer portion of the inlet and substantially annular gas flow passage defined between the inner and outer tubular walls, the substantially annular gas flow passage being in fluid communication with the impeller wheel; and a perforated flow-conditioning member in said flow passage that permits communication between the inlet and the impeller wheel, the flow-conditioning member being perforated by a plurality of flow conduits that extend in substantially the axial direction;

wherein the flow-conditioning member is annular; and wherein the flow conduits are in the form of bores penetrating the flow-conditioning member.

2. A compressor according to claim 1, wherein the flow conduits are substantially circular in cross section.

3. A compressor according to claim 2, wherein the flow conduits are substantially constant in diameter.

4. A compressor according to claim 1, wherein the flow conduits are arranged in a plurality of annular rows around the conditioning member.

5. A compressor according to claim 4, wherein the flow conduits are angularly offset from one row to an adjacent row.

6. A compressor according to claim 1, wherein there is provided an opening in the housing that provides communication between the flow passage and the impeller wheel.

7. A compressor according to claim 6, wherein the opening is in the form of at least one slot.

8. A compressor according to claim 6, wherein the opening is provided in the inner tubular wall.

9. A compressor according to claim 1, wherein there is at least one transition step in the inner or outer tubular wall that serves to reduce the width of the annular flow passage and provides a location stop for the flow-conditioning member.

10. A compressor according to claim 9, wherein the transition step is defined by at least one taper.

11. A compressor according to claim 9, wherein the transition step is an annular ledge and the flow-conditioning member has an annular lip that abuts said ledge.

12. A compressor according to claim 1, wherein the flow-conditioning member has at least one fixing element by which it may be fixed in position by a fixing member.

13. A compressor according to claim 12, wherein the fixing element is a lug formed in an upstream facing surface of the member.

14. A turbocharger comprising a compressor according to claim 1.

* * * * *